US012398665B2

(12) United States Patent
Sage-Aubriot et al.

(10) Patent No.: US 12,398,665 B2
(45) Date of Patent: Aug. 26, 2025

(54) HEATING DEVICE FOR AN EXHAUST SYSTEM AND ASSOCIATED MANUFACTURING METHOD

(71) Applicant: FAURECIA SYSTEMES D'ECHAPPEMENT, Nanterre (FR)

(72) Inventors: Valentin Sage-Aubriot, Auxon-les-Vesoul (FR); Alain Mercier, Nommay (FR); Thomas Denis, Gersthofen (DE); Georg Mosonyi, Gersthofen (DE)

(73) Assignee: FAURECIA SYSTEMES D'ECHAPPEMENT, Nanterre (FR)

( * ) Notice: Subject to any disclaimer, the term of this patent is extended or adjusted under 35 U.S.C. 154(b) by 152 days.

(21) Appl. No.: 18/227,363

(22) Filed: Jul. 28, 2023

(65) Prior Publication Data

US 2024/0044273 A1 Feb. 8, 2024

(30) Foreign Application Priority Data

Aug. 5, 2022 (FR) ..... 22 08138

(51) Int. Cl.
*F01N 3/20* (2006.01)

(52) U.S. Cl.
CPC ..... *F01N 3/2026* (2013.01); *F01N 2240/16* (2013.01)

(58) Field of Classification Search
CPC .. F01N 2240/16; F01N 3/2013; F01N 3/2026; H05B 2203/003; H05B 2203/016; H05B 3/24
See application file for complete search history.

(56) References Cited

U.S. PATENT DOCUMENTS 5,501,842 A 3/1996 Rajnik et al.
2021/0156290 A1* 5/2021 Feng ..... F01N 3/2026

FOREIGN PATENT DOCUMENTS

CN 110856284 B * 6/2022 ..... F24C 15/102
FR 3110808 A1 11/2021
WO 2022235459 A1 11/2022

OTHER PUBLICATIONS

English Translation (Year: 2022).*
Preliminary Search Report for French Application No. 2208138 dated Feb. 13, 2023.

* cited by examiner

*Primary Examiner* — Anthony Ayala Delgado
(74) *Attorney, Agent, or Firm* — Carlson, Gaskey & Olds, P.C.

(57) ABSTRACT

A heating device comprises first and second electrodes attached to a heating plate comprising a plurality of branches each having a proximal end turned from a first longitudinal side of the heating plate and a distal end turned from a second longitudinal side of the heating plate. The branches are separated by slits each opening to at least one longitudinal end. The proximal end and/or distal end of each branch is connected to the proximal end and/or distal end of an adjacent branch. The electrodes are connected to the proximal ends of a first intermediate branch of the intermediate branches and a second intermediate branch of the intermediate branches respectively.

9 Claims, 2 Drawing Sheets

[Fig. 1]
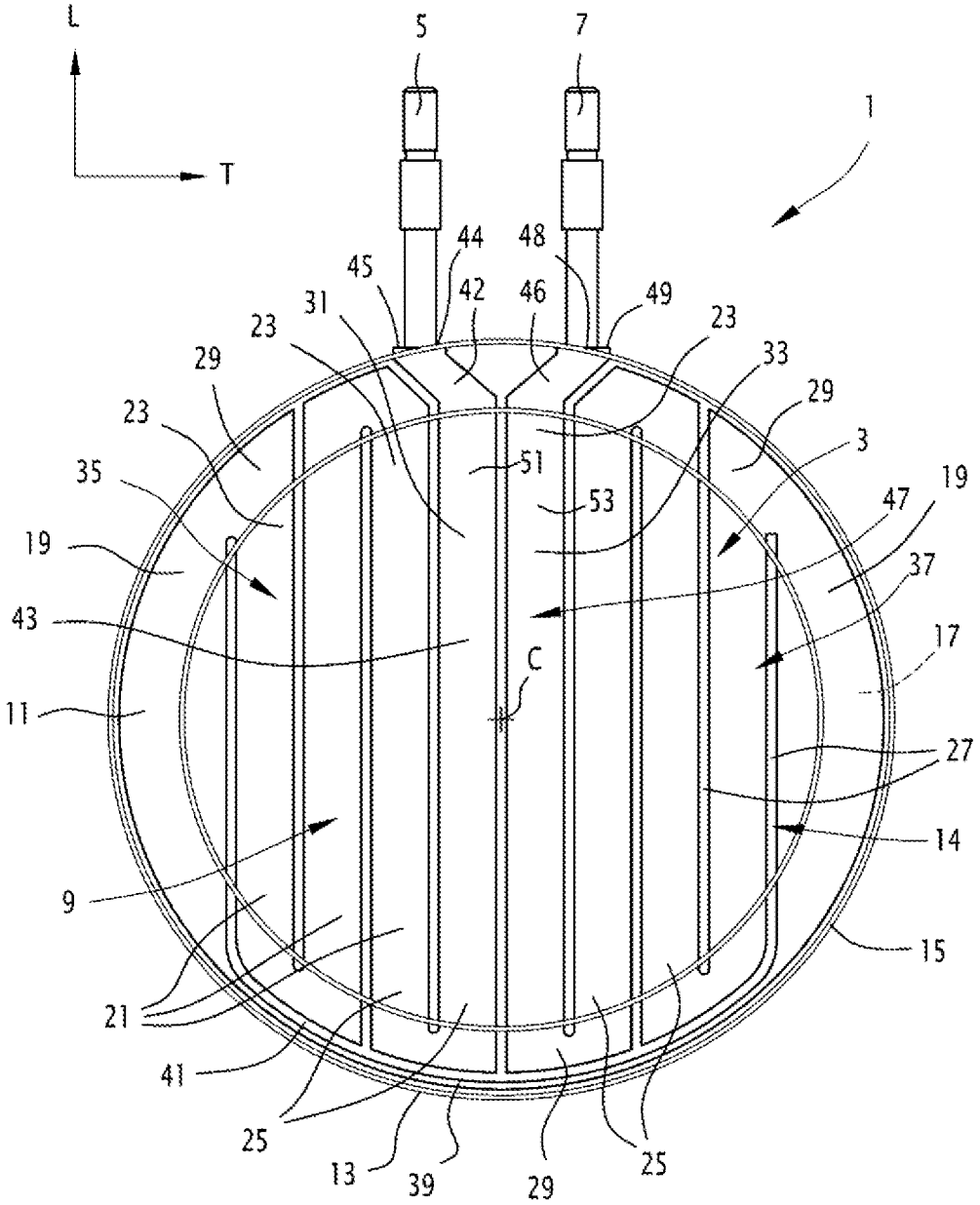

[Fig. 2]
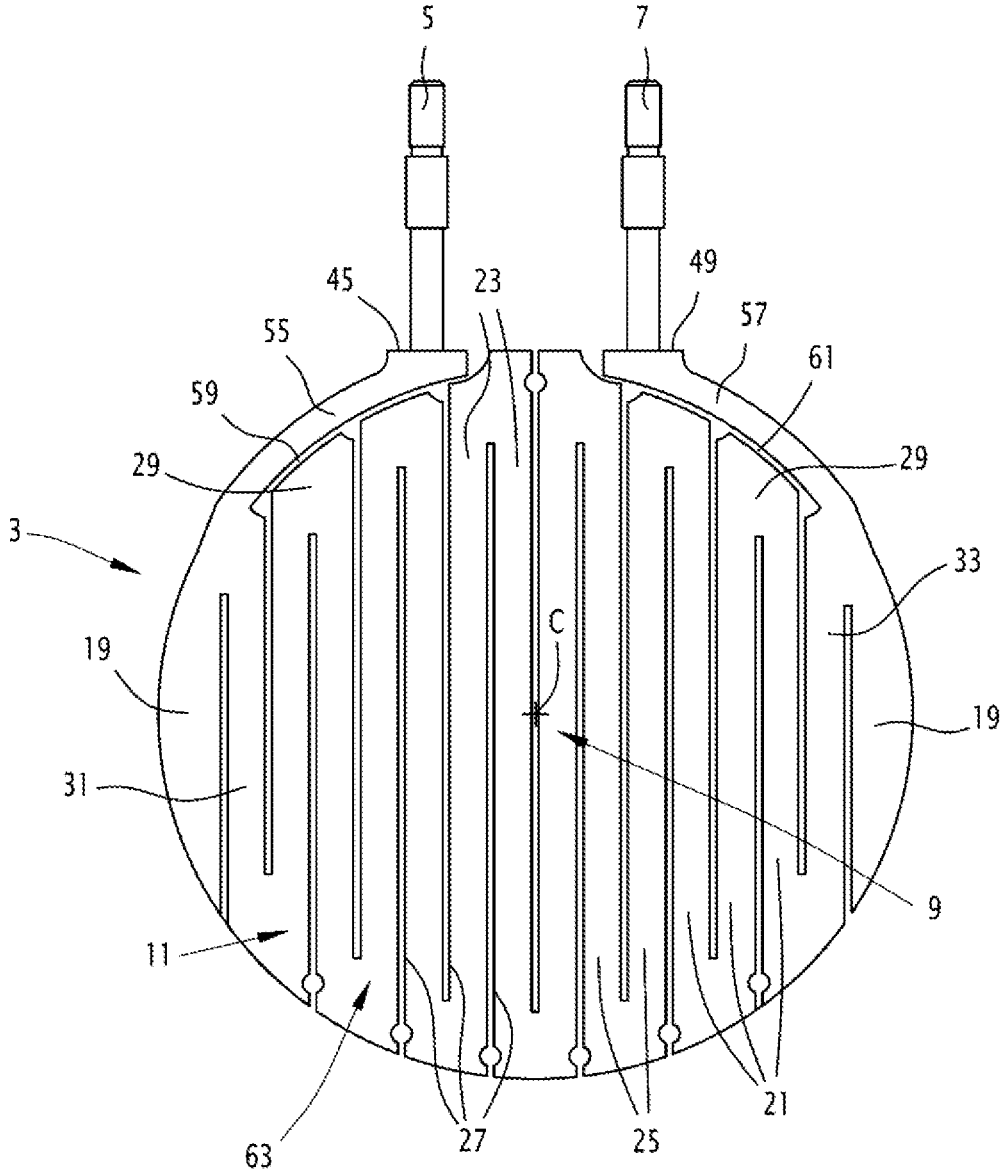

HEATING DEVICE FOR AN EXHAUST SYSTEM AND ASSOCIATED MANUFACTURING METHOD

CROSS-REFERENCE TO RELATED APPLICATION

This application is a U.S. non-provisional application claiming the benefit of French Application No. 22 08138, filed on Aug. 5, 2022, which is incorporated herein by reference in its entirety.

TECHNICAL FIELD

The present disclosure generally relates to a heating device for a vehicle exhaust system.

BACKGROUND

Such a device may comprise a heating plate made of an electrically conductive material and first and second electrodes attached to the heating plate.

The heating plate may comprise a plurality of branches elongated in a longitudinal direction, the branches being juxtaposed in a transverse direction and separated from one another by longitudinal slits.

The electrodes are connected to the two branches located at the ends of the alignment.

The heating plate thus defines a meandering path for the electrical current, from one end branch to the other.

The two electrodes must be connected to an electrical wiring harness, electrically connecting the heating plate to an electric current source, typically to the vehicle battery.

Connecting electrodes to the wiring harness is relatively complex and expensive.

In this context, the disclosure aims to propose a heating device allowing a simpler connection of the electrodes to the electrical wiring harness.

SUMMARY

A heating device for a vehicle exhaust system is provided, the heating device comprising a heating plate made of an electrically conductive material and first and second electrodes attached to the heating plate, the heating plate comprising a plurality of branches elongated in a longitudinal direction, the branches being juxtaposed in a transverse direction and forming a transverse alignment having two end branches located at two transverse ends of the alignment and intermediate branches arranged between the end branches, each branch having a proximal end turned from a first longitudinal side of the heating plate and a distal end turned from a second longitudinal side of the heating plate opposite the first side, the branches being separated from one another by longitudinal slits each emerging from at least one longitudinal end, the proximal end and/or the distal end of each branch being connected respectively to the proximal end and/or the distal end of an adjacent branch in the alignment; the first and second electrodes being connected to the proximal ends of a first of the intermediate branches and a second of the intermediate branches respectively.

Because the first and second electrodes are connected to the proximal ends of two intermediate branches, and not to the two end branches, the first and second electrodes are relatively close to each other. As a result, it is simpler to connect them to the electrical wiring harness.

The heating device may furthermore comprise one or more of the following features, considered alone or according to any technically possible combinations:

- The first and second intermediate branches are adjacent in the alignment.
- The first and second intermediate branches are located transversely to the center of the alignment.
- The heating plate comprises:
  - a first meandering path for the electrical current, comprising the first intermediate branch, a last branch and all the branches located in the alignment between the first intermediate branch and the last branch, the last branch being either one of the end branches or the intermediate branch adjacent to the end branch in the alignment;
  - a second meandering path for the electrical current, including a plurality of adjacent branches in the alignment;
  - a distribution bar, connecting the distal end of the last branch of the first meandering path to the distal end of one of the branches of the second meandering path.
- The first and second meandering paths are made of a relatively less electrically resistive material and the distribution bar is made of a relatively more electrically resistive material.
- The first intermediate branch is adjacent in the alignment to a first of the two end branches, the second intermediate branch is adjacent in the alignment to a second of the two end branches, the heating plate comprising a first distribution bar connecting the first electrode to the proximal end of the first intermediate branch and/or a second distribution bar connecting the second electrode to the proximal end of the second intermediate branch, the electrically conductive material having a first density in the intermediate branches, the electrically conductive material having a second density lower than the first in the end branches.
- The heating plate is obtained by additive manufacturing.
- The first and second electrodes are obtained by additive manufacturing with the heating plate.
- The heating device comprises an annular housing interiorly delimiting a void, the first electrode being connected directly to a terminal segment of the first intermediate branch housed in the annular housing, the first intermediate branch having a central segment passing through the void and having a given central longitudinal length, said terminal segment housed in the housing having a length less than 20% of said central longitudinal length.

According to a second aspect, the disclosure relates to a method for manufacturing a heating device having the above features, the method comprises the following successive steps:

- obtaining the heating plate and the first and second electrodes;
- inserting an edge of the heating plate into an annular housing;
- soldering the first electrode to the proximal end of the first intermediate branch, a point of said first intermediate branch being electrically grounded during the soldering.

BRIEF DESCRIPTION OF THE DRAWINGS

Other features and advantages of the disclosure will become apparent from the detailed description given here-under, by way of non-limiting indication, referring to the appended figures, among which:

FIG. 1 is a schematic top view of a heating device according to a first embodiment of the disclosure; and FIG. 2 is a schematic top view of a heating member according to a second embodiment of the disclosure.

DESCRIPTION OF THE EMBODIMENTS

The heating device 1 shown in FIG. 1 is intended to be integrated into

The vehicle is typically a motor vehicle such as a car, a truck, a bus, etc. a vehicle exhaust system.

The exhaust system is intended to collect the exhaust gases emitted by the combustion engine of the vehicle and releases them into the atmosphere after purification.

In particular, catalytic purification members are provided in the exhaust system. These catalytic members become effective only when their temperature exceeds a critical value.

Therefore, it is advantageous to integrate a heating device into the exhaust system, making it possible to accelerate the temperature rise of the catalytic purification member in the event of a cold start of the internal combustion engine. The exhaust gases passing through the heating device transfer the thermal energy transferred by the heating device to the catalytic purification member by convection.

Alternatively, the heating device heats the catalytic purification member by radiation.

The heating device 1 comprises a heating plate 3 made of an electrically conductive material and first and second electrodes 5, 7 attached to the heating plate 3.

The first and second electrodes 5 and 7 electrically connect the heating plate 3 to the two terminals of an electric generator that is not shown, via an electrical wiring harness that is also not shown.

The heating plate 3 is flat. In the example shown, it is circular. Alternatively, it is oval or has any other suitable shape.

The heating plate 3 has a central zone 9 and a peripheral edge 11 surrounding the central zone 9.

The heating device 1 further comprises an annular housing 13, internally delimiting a void 14.

The peripheral edge 11 of the heating plate 3 is engaged in the annular housing 13.

The central zone 9 occupies the void 14.

In FIG. 1, the annular housing 13 is shown schematically by two concentric circles.

The heating plate 3 has a geometric center C shown in FIG. 1. Considering in a plane perpendicular to the heating plate 3 and passing through the center C, the annular housing 13 has a U-shaped section, open towards the center C.

The annular housing 13 thus delimits an annular groove, open radially towards the interior of the annular housing 13 and wherein the peripheral edge 11 of the heating plate 3 is engaged.

The annular housing 13 thus has a cylindrical bottom 15 and two annular side walls 17 secured to the cylindrical bottom 15. The annular housing 13 has radially, opposite the cylindrical bottom 15, an opening through which the peripheral edge 11 of the heating plate 3 is engaged inside the annular housing 13.

The heating device 1 is housed in a component of the exhaust line, for example inside the envelope receiving the catalytic purification member. It is attached to this envelope by via the annular housing 13.

As shown in FIG. 1, the heating plate 3 comprises a plurality of elongated branches 19, 21 in a longitudinal direction L represented by an arrow in FIG. 1. The branches 19, 21 are juxtaposed in a transverse direction T represented by an arrow in FIG. 1, and thus form a transverse alignment.

The transverse alignment has two end branches 19 located at the two opposite transverse ends of the alignment.

The transverse alignment also comprises intermediate branches 21 arranged between the two end branches 19.

Each branch 19, 21 has a proximal end 23 turned from a first longitudinal side of the heating plate 3, here called proximal side, and a turned distal end 25 turned from a second longitudinal side of the heating plate 3, opposite the first side and referred to herein as the distal side.

The branches 19, 21 are substantially rectilinear.

The branches 19, 21 are separated from each other by longitudinal slits 27, each opening to at least one longitudinal end.

The proximal end 23 and/or the distal end 25 of each branch 19, 21 is connected respectively to the proximal end 23 and/or the distal end 25 of an adjacent branch 19, 21 in the alignment.

As can be seen in the figures, the proximal ends 23 are connected to one another by bends 29, and similarly the distal ends 25 are connected to one another by bends 29. The bends 29 form U-shaped cusps. The longitudinal slits 27 are closed at the bends 29.

The first and second electrodes 5, 7 are connected to the proximal ends 23 respectively of a first intermediate branch, referenced 31, and a second of the intermediate branches, referenced 33.

Advantageously, and as shown in FIG. 1, the first and second intermediate branches 31, 33 are adjacent in the alignment.

Preferably, they are located transversely to the center of the alignment.

Therefore, the heating plate 3 comprises a first meandering path 35 for the electrical current, comprising the first intermediate branch 31, a last branch and all the branches located in the alignment between the first intermediate branch 31 and the last branch.

In the example shown, the last branch is one of the two end branches 19. Alternatively, the last branch is the intermediate branch 21 adjacent to the end branch 19 in the alignment.

The heating plate 3 further comprises a second meandering path 37 for the electrical current, comprising a plurality of branches 19, 21 that are adjacent in the alignment.

In the example shown, the second meandering path 37 comprises the second intermediate branch 33, a last branch and all the branches located in the alignment between the second intermediate branch 33 and the last branch.

The last branch is here the other end branch 19. Alternatively, the last branch is the intermediate branch 21 adjacent to said end branch 19.

The heating plate 3, as can be seen in FIG. 1, also comprises a distribution bar 39, connecting the distal end 25 of the last branch of the first meandering path 35, to the distal end 25 of one of the branches of the second meandering path 37.

In the example shown, the distribution bar 39 connects the respective distal ends 25 of the last branches of the first and second meandering paths 35, 37.

More specifically, the distribution bar 39 connects the respective distal ends 25 of the two end branches 19.

The distribution bar 39 is entirely formed in the peripheral edge 11 of the heating plate 3.

The peripheral edge 11 corresponds to the part of the heating plate 3 which is housed inside the annular housing 13.

The bends 29 are located inside the annular housing 13. They are formed in the peripheral edge 11, typically entirely in the peripheral edge 11.

The distribution bar 39 is located radially outwardly of the bends 29 connecting the distal ends 25 of the branches 19, 21 to one another.

It is separated from these bends 29 by a circumferential slit 41.

The distribution bar 39 is thus situated on the distal side of the heating plate 3, opposite the first and second electrodes 5, 7.

In the example shown, the slits 27 emerge alternately from the proximal side and from the distal side of the heating plate 3.

The slits 27 that emerge on the distal side open into the circumferential slit 41.

The slits 27 that emerge on the proximal side extend at the edge of the heating plate 3.

The slit 27 separating the first intermediate branch 31 from the second intermediate branch 33 is emerging at both ends thereof.

The slits 27 separating the end branches 19 from the adjacent intermediate branches 21 open into the circumferential slit 41.

The electrically conductive material constituting the heating plate 3 is advantageously a porous material, through which the exhaust gases can circulate. The pores are communicating with one another.

The density of the porous material is adjusted by varying the number and/or size of the pores.

Advantageously, the first and second meandering paths 35, 37 are made of a relatively less dense material. On the contrary, the distribution bar 39 is made of a relatively denser material.

Typically, the distribution bar 39 has a smaller pore density than the branches 19, 21, 31, 33, or has pores of smaller sizes.

Thus, the electric current flowing through the distribution bar 39 will generate a moderate amount of heat.

This avoids the creation of hot spots at the distribution bar 39.

Advantageously, the heating plate 3 is obtained by additive manufacturing.

In particular, the branches 19, 21, 31, 33 and the distribution bar 39 are formed of the same part, and are obtained together, in one piece, by additive manufacturing.

The first intermediate branch 31 has a terminal segment 42 housed in the annular housing 13. It also has a central segment 43 passing through the void 14.

The terminal segment 42 corresponds to the entire part of the first intermediate branch 31 housed in the housing 13. It comprises the proximal end 23 of the first intermediate branch 31.

The central segment 43 corresponds to the entire part of the first intermediate branch 31 housed in the housing 13. It extends between the two opposite sides of the annular housing 13. The terminal segment 42 is directly connected to the central segment 43.

The first electrode 5 is directly connected to the terminal segment 42.

It extends longitudinally, in the plane of the heating plate 3, radially towards the outside of the annular housing 13 relative to the center C.

An orifice 44 is provided in the bottom 15 of the annular housing 13. The first electrode 5 is connected to a terminal surface 45 of the terminal segment 42 through the orifice 44.

The central segment 43 has a given central longitudinal length.

The terminal segment 42 housed in the annular housing 13 has a length less than 20% of said central longitudinal length, preferably a length less than 15% of the central longitudinal length, and even more preferentially a length less than 10% of the central longitudinal length.

The terminal segment 42 extends obliquely relative to the longitudinal direction L. If the terminal segment 42 is followed from the central segment 43, it extends radially outwards from the heating plate 3, transversely diverging from the second electrode 7.

The first electrode 5 is thus situated longitudinally in the extension of the slit 27 separating the first intermediate branch 31 from the adjacent intermediate branch 21.

The second intermediate branch 33 has a terminal segment 46 housed in the annular housing 13. It also has a central segment 47 passing through the void 14.

The terminal segment 46 corresponds to the entire part of the second intermediate branch 33 housed in the annular housing 13. It comprises the proximal end 23 of the second intermediate branch 33.

The central segment 47 corresponds to the entire part of the second intermediate branch 33 housed in the housing 13. It extends between the two opposite sides of the annular housing 13. The terminal segment 46 is directly connected to the central segment 47.

The first electrode 7 is directly connected to the terminal segment 46.

It extends longitudinally, in the plane of the heating plate 3, radially towards the outside of the annular housing 13 relative to the center C.

An orifice 48 is provided in the bottom 15 of the annular housing 13. The first electrode 7 is connected to a terminal surface 49 of the terminal segment 46 through the orifice 48.

The central segment 47 has a given central longitudinal length.

The terminal segment 46 housed in the annular housing 13 has a length less than 20% of said central longitudinal length, preferably a length less than 15% of the central longitudinal length, and even more preferentially a length less than 10% of the central longitudinal length.

The terminal segment 46 extends obliquely relative to the longitudinal direction L. If the terminal segment 46 is followed from the central segment 47, it extends radially outwards from the heating plate 3, transversely diverging from the second electrode 7.

The second electrode 7 is thus situated longitudinally in the extension of the slit 27 separating the second intermediate branch 33 from the adjacent intermediate branch 21.

The terminal segments 42 and 46 thus define together a V.

The terminal surfaces 45 and 49, to which the first and second electrodes 5, 7 are respectively soldered, extend in the same plane, substantially perpendicular to the longitudinal direction L.

The electrodes 5 and 7 are parallel to each other, and are located at a short distance from each other.

The disclosure also relates to a method for manufacturing a heating device 1.

The method is particularly well-suited for the manufacture of the heating device 1 according to the first embodiment of the disclosure, shown in FIG. 1.

The method comprises the following successive steps:

Obtaining the heating plate 3 and the first and second electrodes 5, 7;

Inserting an edge 11 of the heating plate 3 into an annular housing 13;

Soldering the first electrode 5 to the proximal end 23 of the first intermediate branch 31, a point 51 of said first intermediate branch 31 being electrically grounded during the soldering.

The heating plate 3 and the first and second electrodes 5, 7 are as described above.

The annular housing 13 is as described above.

The first intermediate branch 31 is as described above.

The second intermediate branch 33 is as described above.

The first electrode 5 is soldered to the terminal surface 45. The point 51 of the first intermediate branch 31 connected to the ground is situated in the central segment 43 of the first intermediate branch 31.

Considering the length of the terminal segment 42 of the first intermediate branch 31, the electrical current lines circulating from the terminal surface 45 to the point 51 are distributed uniformly in the section of the first intermediate branch 31. The electrical current is thus not concentrated in a limited area of the first intermediate branch 31, which could cause preferential melting of a part of the terminal surface 45, and create problems of soldering quality.

Typically, the method also comprises a step of soldering the second electrode 7 to the proximal end 23 of the second intermediate branch 33, a point 53 of the second intermediate branch 33 being electrically grounded during the soldering.

The second electrode 7 is soldered to the terminal surface 49. The point 53 of the second intermediate branch 31 connected to the ground is situated in the central segment 47 of the second intermediate branch 33.

The technical advantages are those mentioned above for the soldering of the first electrode 5.

A second embodiment is now described with reference to FIG. 2.

Only the points through which the second embodiment differs from the first will be detailed below. Elements that are identical or that provide the same functions will be designated by the same references.

In the second embodiment, the first and second electrodes 5, 7 are advantageously obtained by additive manufacturing with the heating plate 3.

In other words, they are integral with the heating plate 3, made of the same material.

Furthermore, the first intermediate branch 31, to which the first electrode 5 is connected, is adjacent in the alignment to a first of the two end branches 19.

In other words, the first intermediate branch 31 is the penultimate branch in the alignment.

Advantageously, the second intermediate branch 33 is adjacent in the alignment to the second of the two end branches 19.

In other words, the second intermediate branch 33 is the penultimate branch in the alignment, opposite the first intermediate branch 31.

In order to allow the arrangement of the first and second electrodes 5, 7 parallel to each other and close to each other, the heating plate 3 comprises a first distribution bar 55 connecting the first electrode 5 to the proximal end 23 of the first intermediate branch 31.

Likewise, the heating plate 3 comprises a second distribution bar 57, connecting the second electrode 7 to the proximal end 23 of the second intermediate branch 33.

The first and second distribution bars 55, 57 are circumferentially oriented. They are entirely arranged in the peripheral edge 11 of the heating plate 3. They are located radially outwardly of the heating plate 3 relative to the bends 29 connecting the proximal ends 23 of the branches 19, 21 to one another.

Circumferential slits 59, 61 separate the first and second distribution bars 57 from the bends 29. Some of the longitudinal slits 27 open into the circumferential slits 59, 61 on the proximal side of the heating plate 3.

The first and second distribution bars 55, 57 extend circumferentially from one another from the first intermediate branch 31 and from the second intermediate branch 33, respectively.

The terminal surfaces 45, 49, bearing the first and second electrodes 5, 7, are provided at the ends of the first and second distribution bars 55, 57. They extend in the same plane, substantially perpendicular to the longitudinal direction L.

The first and second electrodes 5, 7 extend longitudinally.

The heating plate 3 comprises a single meandering path 63 for the electrical current, comprising the first intermediate branch 31, the second intermediate branch 33, and all the other intermediate branches 21 located between the first and second intermediate branches 31 and 33. In other words, the meandering path 63 comprises all the intermediate branches 21.

On the other hand, the two end branches 19 are not integrated into the meandering path 63 wherein the electric current circulates.

The electrically conductive material has a first density in the intermediate branches 21, 31, 33.

In order to reduce the amount of electrically conductive material used to manufacture the heating plate 3, and to reduce the weight of the heating plate 3, it has a second density lower than the first density in the end branches 19.

Typically, the electrically conductive material has a greater pore density in the end branches 19, or pores of larger sizes.

According to a variant embodiment, the electrically conductive material has a second density lower than the first in the entire peripheral edge 11.

According to another alternative embodiment, the electrically conductive material has a second density lower than the first in the first and/or second distribution bars 55, 57.

The first and second distribution bars 55, 57 are connected to the junction bends 29 between the end branches 19 and the first and second intermediate branches 31, 33. Advantageously, said bends 29 have a second density lower than the first.

The heating plate 3 does not have a junction bar on the distal side of the plate, that is opposite the electrodes 5, 7.

The heating device has multiple advantages.

When the first and second intermediate branches are adjacent in the alignment, the first and second electrodes can be arranged particularly close to each other. The connection to the electrical wiring harness is made easier.

When the first and second intermediate branches are located transversely to the center of the alignment, the path of the electrical current is particularly simple to draw. The heating plate can be designed symmetrically.

The fact of integrating the distribution bar connecting the first and second meandering paths into the heating plate makes it possible to make the heating device very compact. The distribution bar makes it possible to organize the circulation of the electric current in the heating plate so as to obtain uniform heating.

When the distribution bar is made of a material that is denser than that constituting the first and second meandering paths, the circulation of the electrical current in the distribution bar does not create a hot spot.

In the second embodiment, the first and second electrodes are connected to the first and second intermediate branches by distribution bars. The first and second intermediate branches are adjacent to the two end branches. These end branches are not integrated into the path of the electrical current. Making the electrically conductive material less dense in the end branches allows the plate to be lighter, reducing the manufacturing cost of the plate.

The fact of manufacturing the heating plate by additive manufacturing makes it possible to conveniently produce heating plates of complex shapes, for example of the type shown in FIGS. 1 and 2.

When the first and second electrodes are also obtained by additive manufacturing with the heating plate, the step of soldering the first and second electrodes is eliminated. Furthermore, there is no discontinuity between the electrode and the plate, which could create a hot spot. The risks of quality defects due to soldering are eliminated.

The manufacturing method of the disclosure offers the advantage that, during the soldering of the first electrode, the point of the first intermediate branch grounded is close, and substantially in the longitudinal extension of the zone to be soldered. As a result, the distribution of the electric current lines during soldering is very uniform in the first intermediate branch, which is favorable for the quality of the soldering.

The heating device could have multiple variants.

The first and second intermediate branches, to which the electrodes are connected, are not necessarily located at the center of the alignment. They could be located at intermediate points between the embodiment shown in FIG. 1 and the embodiment shown in FIG. 2. It would then be necessary to redesign the first and second meandering paths. The plate could in particular comprise a third meandering path between the first and second meandering paths. It would also comprise two distribution bars, one connecting the first meandering path to the third meandering path, and the other connecting the second meandering path to the third meandering path.

The invention claimed is:

1. A heating device for a vehicle exhaust system comprising:

a heating plate made of an electrically conductive material and first and second electrodes attached to the heating plate, the heating plate comprising a plurality of branches elongated in a longitudinal direction, the plurality of branches being juxtaposed in a transverse direction and forming a transverse alignment having two end branches located at two transverse ends of the transverse alignment and intermediate branches arranged between the two end branches, each branch having a proximal end turned from a first longitudinal side of the heating plate and a distal end turned from a second longitudinal side of the heating plate opposite the first longitudinal side, the plurality of branches being separated from one another by longitudinal slits each emerging from at least one longitudinal end, the proximal end and/or the distal end of each branch being connected respectively to the proximal end and/or the distal end of an adjacent branch in the transverse alignment;

the first and second electrodes being connected to the proximal ends of a first intermediate branch of the intermediate branches and a second intermediate branch of the intermediate branches respectively;

wherein the first intermediate branch is adjacent in the transverse alignment to a first of the two end branches, the second intermediate branch is adjacent in the transverse alignment to a second of the two end branches, the heating plate comprising a first distribution bar connecting the first electrode to the proximal end of the first intermediate branch and/or a second distribution bar connecting the second electrode to the proximal end of the second intermediate branch, the electrically conductive material having a first density in the intermediate branches, the electrically conductive material having a second density lower than the first in the two end branches.

2. The heating device according to claim 1, wherein the first and second intermediate branches are adjacent in the transverse alignment.

3. The heating device according to claim 1, wherein the first and second intermediate branches are located transversely to a center of the transverse alignment.

4. The heating device according to claim 1, wherein the heating plate comprises:

a first meandering path for electrical current, comprising the first intermediate branch, a last branch and all branches located in the transverse alignment between the first intermediate branch and the last branch, the last branch being either one of the two end branches or an intermediate branch adjacent to one of the two end branches in the transverse alignment;

a second meandering path for the electrical current, including a plurality of adjacent branches in the transverse alignment;

a distribution bar, connecting the distal end of the last branch of the first meandering path to the distal end of one of the plurality of branches of the second meandering path.

5. A heating device for a vehicle exhaust system comprising:

a heating plate made of an electrically conductive material and first and second electrodes attached to the heating plate, the heating plate comprising a plurality of branches elongated in a longitudinal direction, the plurality of branches being juxtaposed in a transverse direction and forming a transverse alignment having two end branches located at two transverse ends of the transverse alignment and intermediate branches arranged between the two end branches, each branch having a proximal end turned from a first longitudinal side of the heating plate and a distal end turned from a second longitudinal side of the heating plate opposite the first longitudinal side, the plurality of branches being separated from one another by longitudinal slits each emerging from at least one longitudinal end, the proximal end and/or the distal end of each branch being connected respectively to the proximal end and/or the distal end of an adjacent branch in the transverse alignment;

the first and second electrodes being connected to the proximal ends of a first intermediate branch of the intermediate branches and a second intermediate branch of the intermediate branches respectively;

wherein the heating plate comprises:

a first meandering path for electrical current, comprising the first intermediate branch, a last branch and all branches located in the transverse alignment between the first intermediate branch and the last branch, the last branch being either one of the two end branches or an intermediate branch adjacent to one of the two end branches in the transverse alignment;

a second meandering path for the electrical current, including a plurality of adjacent branches in the transverse alignment;

a distribution bar, connecting the distal end of the last branch of the first meandering path to the distal end of one of the plurality of branches of the second meandering path;

wherein the first and second meandering paths are made of a relatively less electrically resistive material and the distribution bar is made of a relatively more electrically resistive material.

6. The heating device according to claim 1, wherein the heating plate is obtained by additive manufacturing.

7. The heating device according to claim 1, wherein the first and second electrodes are obtained by additive manufacturing with the heating plate.

8. A heating device for a vehicle exhaust system comprising:

a heating plate made of an electrically conductive material and first and second electrodes attached to the heating plate, the heating plate comprising a plurality of branches elongated in a longitudinal direction, the plurality of branches being juxtaposed in a transverse direction and forming a transverse alignment having two end branches located at two transverse ends of the transverse alignment and intermediate branches arranged between the two end branches, each branch having a proximal end turned from a first longitudinal side of the heating plate and a distal end turned from a second longitudinal side of the heating plate opposite the first longitudinal side, the plurality of branches being separated from one another by longitudinal slits each emerging from at least one longitudinal end, the proximal end and/or the distal end of each branch being connected respectively to the proximal end and/or the distal end of an adjacent branch in the transverse alignment;

the first and second electrodes being connected to the proximal ends of a first intermediate branch of the intermediate branches and a second intermediate branch of the intermediate branches respectively;

wherein the heating device comprises an annular housing interiorly delimiting a void, the first electrode being connected directly to a terminal segment of the first intermediate branch housed in the annular housing, the first intermediate branch having a central segment passing through the void and having a given central longitudinal length, said terminal segment housed in the annular housing having a length less than 20% of said given central longitudinal length.

9. A method for manufacturing the heating device according to claim 8, the method comprising the following successive steps:

obtaining the heating plate and the first and second electrodes;

inserting an edge of the heating plate into the annular housing;

soldering the first electrode to the proximal end of the first intermediate branch, a point of said first intermediate branch being electrically grounded during the soldering.

* * * * *